US007951263B2

(12) United States Patent
Järvinen et al.

(10) Patent No.: US 7,951,263 B2
(45) Date of Patent: May 31, 2011

(54) METHOD AND APPARATUS FOR TREATING PULP

(75) Inventors: Marita Järvinen, Espoo (FI); Kimmo Nurminen, Siltakylä (FI)

(73) Assignee: Andritz Oy, Helsinki (FI)

( * ) Notice: Subject to any disclaimer, the term of this patent is extended or adjusted under 35 U.S.C. 154(b) by 74 days.

(21) Appl. No.: 12/360,707

(22) Filed: Jan. 27, 2009

(65) Prior Publication Data

US 2009/0188635 A1 Jul. 30, 2009

(30) Foreign Application Priority Data

Jan. 28, 2008 (FI) ..... 20080063

(51) Int. Cl.
*D21C 9/08* (2006.01)

(52) U.S. Cl. ..... 162/55; 162/232

(58) Field of Classification Search ..... 162/55, 162/232

See application file for complete search history.

(56) References Cited

U.S. PATENT DOCUMENTS

| | | | | |
|---|---|---|---|---|
| 2,377,524 | A | 6/1945 | Samson et al. | |
| 3,849,245 | A * | 11/1974 | Marsh et al. | 162/4 |
| 4,155,839 | A | 5/1979 | Seifert et al. | |
| 4,451,358 | A | 5/1984 | Chupka | |
| 4,676,809 | A | 6/1987 | Fjallstrom et al. | |
| 4,810,264 | A | 3/1989 | Dewitz | |
| 5,049,277 | A | 9/1991 | Kalnins | |
| 5,131,980 | A | 7/1992 | Chamblee et al. | |
| 5,681,480 | A * | 10/1997 | Langley et al. | 210/727 |
| 6,003,683 | A | 12/1999 | McCarthy | |
| 6,277,239 | B1 | 8/2001 | Kemper et al. | |
| 6,315,127 | B1 | 11/2001 | Wilhelm et al. | |
| 6,391,153 | B1 * | 5/2002 | Wikdahl | 162/55 |
| 7,141,139 | B2 | 11/2006 | Meinander et al. | |
| 2002/0011318 | A1 * | 1/2002 | Jong | 162/55 |
| 2006/0254732 | A1 * | 11/2006 | Dockal-Baur et al. | 162/4 |

FOREIGN PATENT DOCUMENTS

| | | |
|---|---|---|
| WO | WO 97/06871 | 2/1997 |
| WO | WO 98/11296 | 3/1998 |
| WO | 2004/097106 | 11/2004 |
| WO | 2006/087431 | 8/2006 |

* cited by examiner

*Primary Examiner* — Mark Halpern
(74) *Attorney, Agent, or Firm* — Nixon & Vanderhye P.C.

(57) ABSTRACT

A method of dividing a suspension, especially a fiber suspension into an accept fraction and a fraction containing impurity particles in a centrifugal cleaning plant having at least two stages. The suspension is fed to a preceding stage, wherefrom a heavier fraction of the suspension is taken as accept fraction and a lighter fraction is taken as fraction containing impurity particles. The lighter fraction containing impurity particles is fed into a latter stage of the centrifugal cleaning plant. Before being fed to the latter stage, the feed consistency of the lighter fraction is increased.

15 Claims, 2 Drawing Sheets

METHOD AND APPARATUS FOR TREATING PULP

RELATED APPLICATION

This application claims priority to Finnish patent application 2008-0063 filed 28 Jan. 2008, the entirety of which application is incorporated by reference.

BACKGROUND OF THE INVENTION

The present invention relates to a method of and apparatus for treating pulp, such as a suspension of cellulosic fibrous material, with hydrocyclone cleaners. Pulp is treated with hydrocyclone cleaners in a centrifugal cleaning plant for separating impurities from the pulp.

Hydrocyclone cleaners are commonly used in the pulp and paper industry for cleaning fiber suspensions. The purpose of conventional hydrocyclone cleaners is to separate sand and other heavy fractions, as well as other impurity particles originating from wood, such as bark, and to reduce the shive-content of the pulp.

In a conventional hydrocyclone cleaner, material in the pulp that is heavier than fiber and water is separated into reject faction of the pulp. The feed pulp is a stream of pulp flowing into the hydrocyclone cleaner. The feed pulp is divided into two fractions, which are an accept faction (or just accept) that is taken out from the top of the cleaner and a reject faction (or just reject) that is taken out from the bottom of the cleaner. The feed pulp is thickened into the reject, whereby the reject faction is at a higher consistency than the feed pulp and the accept faction is at a lower consistency than the feed pulp. Consistency in a pulp suspension may be viewed as the mass or weight percentage of pulp fibers in the suspension. In general, consistency is the mass or weight percentage of particles in a suspension.

In a hydrocyclone cleaner, the pulp is fed at a low consistency to a conical vortex chamber wherein pressure energy in the pulp is converted to a rotating motion in the chamber. In a hydrocyclone cleaner, the separation of particles from fibers takes place under the influence of a centrifugal acceleration field resulting from the rotating motion. A precondition for the separation of particles in the conical vortex chamber is that the particles must move in relation to each other. It is known that this is possible only at low pulp consistencies; otherwise the fiber network in the pulp binds small impurities to itself and no separation occurs between the fibers and impurities in the vortex chamber. The efficiency of the vortex chamber in separating particles to be removed is dependent on the size, shape and density of the particles, and of the control variables such as the inlet velocity, density, and the pressure difference between the feed and the accept.

In reverse centrifugal cleaning, water and material lighter than fiber is separated into the reject faction. The pulp fed to the hydrocyclone cleaner is divided into two fractions, such as an accept faction and a reject faction. The locations of the outlets for these fractions on the hydrocyclone cleaner are reverse as compared to a conventional hydrocyclone. In reverse centrifugal cleaning, the accept faction is discharged from the bottom of the hydrocyclone cleaner and the reject faction from the top of the cleaner. The feed pulp is thickened into the accept faction, whereby the reject faction is at a lower consistency than the feed pulp and the accept faction is at a higher consistency than the feed pulp.

In building and connecting a reverse centrifugal cleaning plant, the use of a conventional process, such as presented in U.S. Pat. No. 6,003,683, is known. In such conventional processes, a reverse centrifugal cleaning plant is constructed such that the first stage is provided with a so-called reverse hydrocyclone cleaner and the second stage with so-called three-way cleaners. A three-way cleaner is not a reverse hydrocyclone cleaner, but it is mainly a combination of a conventional and a reverse hydrocyclone cleaner. In a three-way cleaner, the reject is taken at a low location from the center of the cleaner axially and the accept is taken at a low position from the outer wall of the cleaner tangentially. The use of a three-way cleaner is based on the possibility to take out remarkably less reject than from a reverse hydrocyclone cleaner, whereby the total reject flow of the plant remains low. Additionally, the pressure difference applied in a three-way cleaner is considerably smaller than in a reverse hydrocyclone cleaner, whereby it is more energy-efficient. On the other hand, the separation efficiency of a three-way cleaner for particles lighter than fiber and water is lower.

In a conventional reverse centrifugal cleaning plant used by e.g. KBC (Kadant Black Clawson), the accept from the first stage is led further to a thickener and dilute reject is fed into a second stage. This means that the feed consistency of the second stage is very low. From the second stage the accept is led further into a dilution water or white-water tank and the reject is led to a clarifier. This kind of solution is presented e.g. in publication WO 97/06871.

Another solution commonly used in conventional reverse centrifugal cleaning plants is to use cascade connection. For instance GL&V (Groupe Laperrière & Verreault Inc.) builds a reverse centrifugal cleaning plant using cascade connection and in both stages reverse hydrocyclones.

In a conventional reverse centrifugal cleaning plant of GL&V, the accept from the first stage is led further to a thickener and dilute reject is fed into a second stage. This means that the feed consistency of the second stage is very low in this solution. From the second stage the accept is led back into the first stage feed (so-called cascade-connected system) and the reject is led to a clarifier. A solution of this type is presented e.g. in publication WO 98/11296.

The use of prior art reverse vortex cleaning plants involves the problem of low separation efficiency of the second stage or stages after that. When studying the separation efficiency of a reverse hydrocyclone cleaner for impurities lighter than fiber and water, such as wax, we (the inventors) noticed that the separation efficiency is highly dependent on the consistency of the feed suspension. It has earlier been thought that a hydrocyclone cleaner operates efficiently only at a consistency low enough.

BRIEF DESCRIPTION OF THE INVENTION

Now our studies led to a totally new discovery. We discovered that if the consistency is low, a reverse hydrocyclone cleaner does not efficiently separate impurities lighter than fiber and water. The flow/reject ratio also has an effect on hydrocyclone cleaner efficiency, but less significant than the consistency of the suspension fed to the cleaner. The present known solutions use process connections, in all of which the feed consistency of the latter stage is low, which results in a low separation efficiency.

We have invented a solution for the above problem. In one embodiment, the invention comprises increasing the feed consistency of one or more latter stages of a vortex cleaning plant. Increasing the feed consistency of one or more latter stages results in a remarkable increase in separation efficiency.

In one embodiment of the invention, the process connection of a reverse centrifugal cleaning plant is carried out so that the feed consistency of a latter stage is increased for improving the separation efficiency. To increase the consistency of a feed suspension to a latter stage a portion of the accept fraction, a suspension of recycled fibers process or other pulp suspension (collectively "auxiliary pulp") is added to the feed suspension. The auxiliary pulp may any fiber flow outside the recycled fiber process. The feed consistency can be increased to the second, third and subsequent stages of the reverse centrifugal cleaning plant.

BRIEF DESCRIPTION OF THE DRAWINGS

In the following, embodiments of the invention are disclosed in more detail with reference to the appended figures, of which.

DETAILED DESCRIPTION OF THE INVENTION

Figure 1:
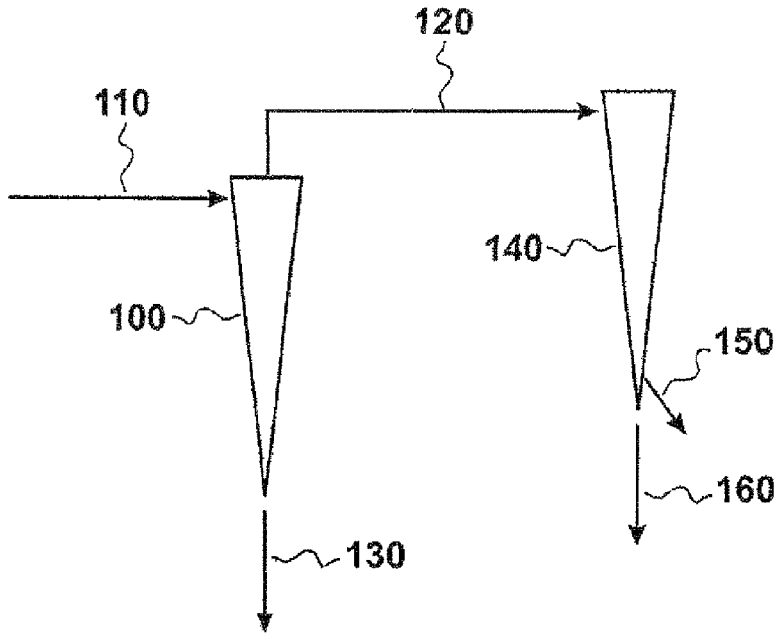
Fig. 1 Prior Art
FIG. 1 illustrates schematically the process connection of a prior art centrifugal cleaning plant.

FIG. 1 is a schematic illustration of a prior art solution, wherein a reverse centrifugal cleaning plant is connected so that the first stage has reverse hydrocyclone cleaners and the second stage has three-way cleaners. In the solution of FIG. 1 the accept from the second stage is led forward (so-called forward connection).

The solution of FIG. 1 has a reverse centrifugal cleaning plant, wherein the first stage has reverse hydrocyclone cleaners 100 and the second stage has three-way cleaners 140. The fiber suspension is fed via line 110 into the reverse hydrocyclone cleaners 100 of the first stage, in which cleaners about 40% (percent) of it is led into reject via line 120 and about 60% into accept via line 130, calculated from the volume flow of the first stage feed (in line 110). The reject from the first stage led into line 120 is at a considerably lower consistency than the suspension fed into the first stage via line 110. The dilute reject is led via line 120 into the three-way cleaners 140 of the second stage, in which cleaners about 10% of it is led into reject via line 160 and about 90% into accept via line 150, calculated from the volume flow of the feed via line 120. The accept from the second stage is led forward via line 150, i.e. the plant has so-called forward connection.

Figure 2:
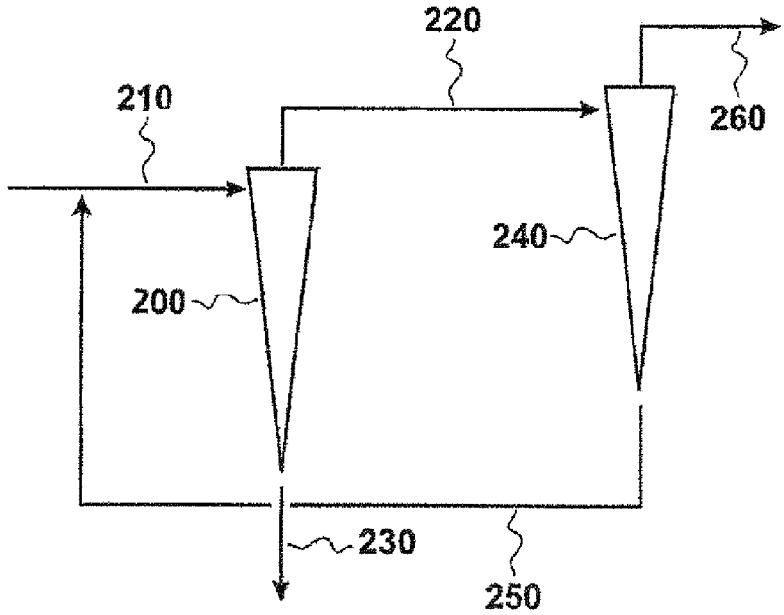
Fig. 2 Prior Art
FIG. 2 illustrates schematically a process connection of a prior art reverse centrifugal cleaning plant.

FIG. 2 is a schematic illustration of a prior art process connection of a reverse centrifugal cleaning plant, wherein both stages have reverse hydrocyclone cleaners. The accept from the second stage of the centrifugal cleaning plant is led back into the first stage feed (so-called cascade connection). In the solution according to the figure, both stages have reverse hydrocyclone cleaners 200 and 240. The fiber suspension is fed via line 210 into the reverse hydrocyclone cleaners 200, wherein about 25% of it is led into reject via line 220 and about 75% into accept via line 230, calculated from the volume flow of the first stage feed in line 210. The reject from the first stage is at a considerably lower consistency that the fiber suspension fed into the first stage. The dilute reject is led via line 220 to the reverse hydrocyclone cleaners 240 of the second stage, wherein about 25% of it is led into reject via line 260 and about 75% into accept via line 250, calculated from the volume flow of the second stage hydrocyclone cleaner feed in line 220. The accept from the second stage is led via line 250 into the first stage feed into line 210, i.e. the plant has a so-called cascade connection.

Figure 3:
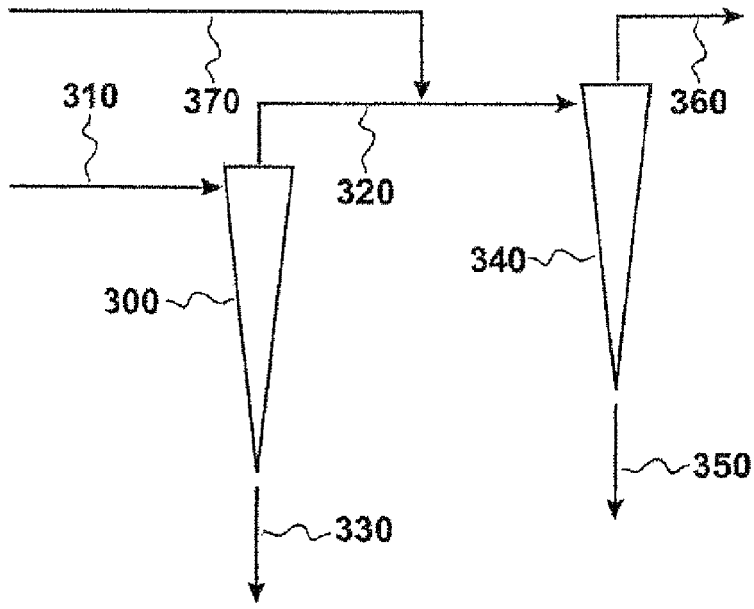
FIG. 3 illustrates schematically a process connection of a reverse centrifugal cleaning plant according to an embodiment of the present invention.

FIG. 3 illustrates schematically a solution according to a preferred embodiment of the invention, in which both stages have reverse hydrocyclone cleaners 300 and 340 and these stages may be coupled in a cascade arrangement. In practice, each stage of a centrifugal cleaning plant has a number of hydrocyclone cleaners. In this kind of schematic illustrations it is common practice to show only one, such as in this figure. Every hydrocyclone cleaner of one stage in the centrifugal cleaning plant is here referred to using one reference numeral only, e.g., 300, 340.

The fiber suspension is fed via input line (conduit) 310 into the reverse hydrocyclone cleaners 300 of the first stage, in which cleaners a fraction of about 40% of the fiber suspension feed through inlet line 310 flows as reject to a top discharge and into line 320, and about a fraction of about 60% flows as accept to a bottom discharge into line 330, wherein the percentages are calculated from the volume flow of the first stage feed. The reject from the first stage cleaners 300 that discharges into line (conduit) 320 is at a considerably lower consistency than the suspension fed into the first stage cleaners 300 via line 310. The consistency of the reject discharged from the first stage cleaners is increased by introducing into the reject flow in line 320 via line 370 auxiliary pulp which is from another fiber stream at a higher consistency than the first stage reject and may be obtained from the recycled fiber process or outside the process. The second stage cleaners 340 divides the combined flow of rejects from the first stage cleaners and the fiber stream entering via line 370 into an accept fraction of pulp fibers discharged from the bottom of the second stage cleaners into line 350, e.g., a forward flow line, and a reject fraction of impurities discharged from a top of the cleaners into line 360.

Figure 4:
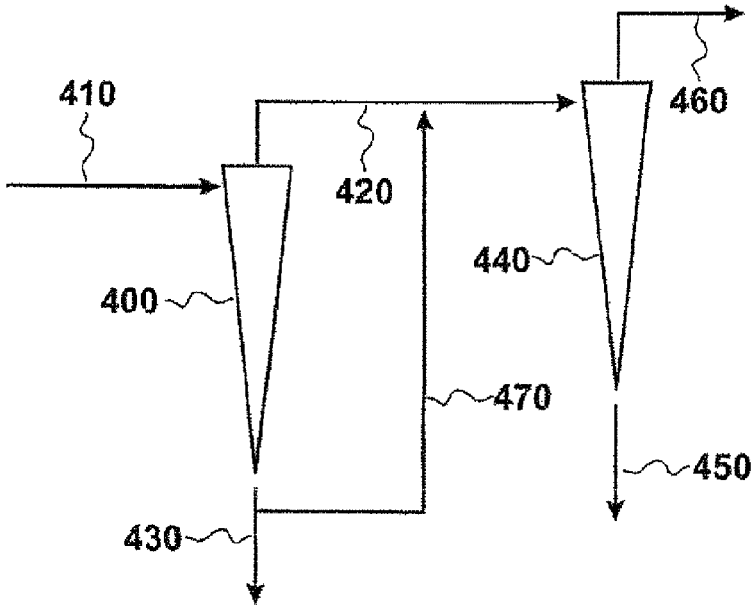
FIG. 4 illustrates schematically a process connection of a reverse centrifugal cleaning plant according to another embodiment of the present invention.

FIG. 4 illustrates schematically a solution according to another preferred embodiment of the invention. Both stages of the centrifugal cleaning plant have reverse hydrocyclone cleaners 400 and 440, and these stages may be coupled in a cascade arrangement. Also in this solution, each stage of the centrifugal cleaning plant has in practice several hydrocyclone cleaners, of which only one is illustrated here.

Every hydrocyclone cleaner of one stage in the centrifugal cleaning plant is here referred to using one reference numeral only, e.g., 400, 440. The fiber suspension is fed via line (conduit) 410 into the reverse hydrocyclone cleaners 400 of the first stage, in which cleaners a fraction of about 40% of the fiber suspension feed through inlet line 410 flows as reject to a top discharge and into line 420, and about a fraction of about 60% flows as accept to a bottom discharge into line 430, wherein the percentages are calculated from the volume flow of the first stage feed. The reject from the first stage cleaners 400 that discharges into line (conduit) 420 is at a considerably lower consistency than the suspension fed into the first stage cleaners 400 via line 410. The consistency of the first stage reject is increased by introducing into the reject flow in line 420 via line 470 auxiliary pulp which is part of the first stage accept from line 430 and at a higher consistency than the reject flow from the first stage. The second stage cleaners 440 divide the combined flow of rejects from the first stage cleaners 400 and the fiber stream entering via line 470 into an accept fraction of pulp fibers discharged from the bottom of the second stage cleaners into line 450, e.g., a forward flow line, and a reject fraction of impurities discharged from a top of the cleaners into line 460.

In case of a centrifugal cleaning plant with more than two stages, the consistency increase of a latter stage may be arranged to the feed of one or more latter stages. Thus, the consistency increase may take place e.g. in the feed of a second stage, a third stage or a second and a third stage or optionally between any two stages or between a greater number of stages. The consistency of the pulp being fed into a latter stage is increased preferably to a range of 0.4-0.8%.

The process connection of a centrifugal cleaning plant may be cascade or forward. The reject-to-flow ratio of the stages is preferably about 40%.

In the above, two preferred embodiments of the invention shown in FIGS. 3 and 4 have been disclosed. The invention is nevertheless not limited to these two embodiments, but the scope of the invention is defined by the appended claims.

The inventive methods disclosed herein may include dividing a suspension, especially a fiber suspension, into an accept fraction and a fraction containing impurity particles in a reverse centrifugal cleaning plant having at least two stages, in which method the suspension is fed into a preceding stage 300, 400 of a reverse-function centrifugal cleaning plant, wherefrom heavier fraction is taken out as accept fraction 330, 430 and lighter fraction is taken out as a fraction containing impurity particles, i.e. reject 320, 420, and the lighter fraction containing impurity particles, i.e. reject 320, 420 is fed into a subsequent stage 340, 440 of the centrifugal cleaning plant, characterized in that the feed consistency of at least one latter stage 340, 440 of the reverse centrifugal cleaning plant is increased.

The method may be further characterized in that the feed consistency of the latter stage 340, 440 is increased by feeding into the latter stage 340, 440 in addition to the reject 320, 420 from a previous stage also some other process flow 370, 470 having a higher consistency. More preferably the flow with a higher consistency is part of the accept (430) from a preceding stage 400. In addition, the increased consistency of the pulp fed into at least one latter stage 340, 440 is preferably between 0.4% to 0.8%.

In the method, the centrifugal cleaning plant may have a cascade connection between the stages. The centrifugal cleaning plant may also have a forward connection. Further, the flow/reject ratio of the centrifugal cleaning stages is preferably about 40%.

Another embodiment of the invention is a centrifugal cleaning plant with at least two stages for dividing a suspension, especially a fiber suspension, into an accept fraction and a fraction containing impurity particles, has been the hydrocyclone cleaners 300, 400, 340, 440 of which centrifugal cleaning plant operate in reverse mode such that the heavier fraction is taken out from the hydrocyclone cleaner 300, 400, 340, 440 as accept fraction and the lighter fraction is taken out from the hydrocyclone cleaner 300, 400, 340, 440 as a fraction containing impurity particles, i.e. reject, wherein a line (conduit) 320, 420 leading to the feed line of the latter stage 340, 440 is provided with a line for introducing into the latter stage a suspension at a higher consistency for increasing the consistency of the feed suspension.

In the another embodiment of the centrifugal cleaning plant, a line 370 may be provided for introducing part of a recycled fiber process flow at a higher consistency into a line 320 for increasing the feed consistency of a latter stage 340. Further, a line 470 may be provided for introducing part of the accept from a preceding stage into a line 420 for increasing the feed consistency of a latter stage 440.

Further, the another embodiment of the centrifugal cleaning plant may include a cascade connection between stages of the plant. Further, the centrifugal cleaning plant may have a forward connection.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for dividing a suspension comprising:

feeding the suspension to a preceding stage of a reverse-function centrifugal cleaning plant, wherein the preceding stage separates a heavier fraction from a lighter fraction of the suspension, and the heavier fraction is an accept fraction and the lighter fraction contains impurity particles, feeding the lighter fraction containing the impurity particles to a subsequent stage of the reverse-function centrifugal cleaning plant, and increasing a feed consistency of the lighter fraction flowing between the preceding stage and the subsequent stage.

2. The method according to claim 1 wherein the suspension comprises cellulosic fiber material.

3. The method according to claim 1 wherein a ratio of flow to the impurity particles in the lighter fraction is in a range of 30 percent to 50 percent.

4. The method according to claim 1 wherein the impurity particles are rejects.

5. The method according to claim 1 wherein the step of increasing the feed consistency includes adding to the lighter fraction a process flow having a consistency higher than a consistency of the lighter fraction when discharged from the preceding stage.

6. The method according to claim 5 wherein the process flow with having the higher consistency is a portion of the heavier fraction discharged by the preceding stage.

7. The method according to claim 1 wherein the step of increasing the feed consistency includes increasing the feed consistency of the lighter fraction to between 0.4 percent and 0.8 percent.

8. The method according to claim 1 wherein the preceding stage and the subsequent stage have a cascade connection.

9. The method according to claim 1 wherein the centrifugal cleaning plant has a forward connection.

10. A method for removing impurity particles from a suspension of cellulosic fibers, the method comprising:

feeding the suspension of cellulosic fibers with impurity particles to a preceding stage of a reverse-function centrifugal cleaning plant, wherein the preceding stage separates a heavier fraction of the suspension from a lighter fraction of the suspension;

feeding the lighter fraction containing the impurity particles to a subsequent stage of the reverse-function centrifugal cleaning plant, and increasing a feed consistency of the lighter fraction after being discharged from the preceding stage and before the lighter fraction is fed to the subsequent stage.

11. The method of claim 10 wherein the feed consistency of the lighter fraction is increased by adding to the lighter fraction a portion of the heavier fraction discharged from the preceding stage.

12. The method according to claim 10 wherein the feed consistency of the lighter fraction is increased by adding a suspension of recycled fibers having a consistency greater than the feed consistency of the lighter fraction discharged from the preceding stage.

13. The method according to claim 10 wherein the feed consistency of the lighter fraction is increased to a consistency between 0.4 percent and 0.8 percent.

14. The method according to claim 10 wherein the preceding stage and the subsequent stage of the reverse-function centrifugal cleaning plant have a cascade connection.

15. The method according to claim 10 wherein a ratio of flow to the impurity particles in the lighter fraction is in a range of 30 percent to 50 percent.

* * * * *